US006930573B2

(12) United States Patent
Ciarcia et al.

(10) Patent No.: US 6,930,573 B2
(45) Date of Patent: Aug. 16, 2005

(54) INTERLOCKING CASSETTES FOR DIMENSIONAL STABILITY

(75) Inventors: Ronald Ciarcia, Bristol, CT (US); Ananthram Subramanian, Secunderabad (IN); Macha Narender, Chikkadapally (IN); Luis Brignoni, Puerto Rico, PR (US); Samuel Kim, Bristol, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/652,356

(22) Filed: Aug. 29, 2003

(65) Prior Publication Data

US 2005/0046528 A1 Mar. 3, 2005

(51) Int. Cl.[7] ..... H01H 77/00
(52) U.S. Cl. ..... 335/8; 335/202
(58) Field of Search ..... 335/165–176, 335/6, 8–10, 16, 132, 202; 200/295–308

(56) References Cited

U.S. PATENT DOCUMENTS

| | | | | |
|---|---|---|---|---|
| 4,166,988 A | | 9/1979 | Ciarcia et al. | 335/9 |
| 5,287,077 A | | 2/1994 | Arnold et al. | 335/8 |
| 6,037,555 A | | 3/2000 | Castonguay et al. | 218/157 |
| 6,064,018 A | | 5/2000 | Seymour et al. | 200/293 |
| 6,188,036 B1 | | 2/2001 | Arnold | 218/157 |
| 6,239,398 B1 | | 5/2001 | Doughty et al. | 218/22 |
| 6,313,425 B1 | | 11/2001 | Doughty et al. | 218/149 |
| 6,317,018 B1 | | 11/2001 | Castonguay et al. | 335/8 |
| 6,429,760 B1 | | 8/2002 | Greenberg et al. | 335/202 |
| 6,476,697 B2 | * | 11/2002 | Swartzentruber et al. | 335/132 |
| 6,531,941 B1 | | 3/2003 | Greenberg et al. | 335/202 |
| 6,552,637 B2 | | 4/2003 | Castonguay et al. | 335/9 |

* cited by examiner

*Primary Examiner*—Lincoln Donovan
(74) *Attorney, Agent, or Firm*—Cantor Colburn LLP

(57) ABSTRACT

A multipole cassette assembly having a center pole cassette assembly includes a first side and a second side, a first outer pole cassette assembly having a first side and a second side, a first spacer interlocking receptacle positioned on one of the first side of the center pole cassette assembly and the second side of the first outer pole cassette assembly, and a first interlocking spacer positioned on one of the first side of the center pole cassette assembly and the second side of the first outer pole cassette assembly, wherein the first interlocking spacer is engaged with the first spacer interlocking receptacle. A method for maintaining spacing between poles of the multipole cassette assembly includes providing an interlocking spacer on the first cassette assembly, providing an interlocking receptacle on a second cassette assembly, and engaging the interlocking spacer with the interlocking receptacle.

18 Claims, 4 Drawing Sheets

INTERLOCKING CASSETTES FOR DIMENSIONAL STABILITY

BACKGROUND OF THE INVENTION

This invention relates generally to circuit breakers, and, more particularly, this invention relates to interlocking cassettes for circuit breakers.

A current limiting circuit breaker is generally a high current circuit interrupting device capable of substantially limiting the duration and the intensity of current destined to flow in a circuit experiencing short circuit fault. To limit the duration and the intensity of short circuit currents, a circuit breaker must, within the shortest possible time, separate its contacts. This separation of the contacts is achieved by rapidly accelerating movable contact arms through an open gap. Upon the intense overcurrent conditions that result in the separation of the contacts, however, arcing often occurs between various parts in the circuit breaker. Arcing between the contacts is usually extinguished by passing the arc through an arc dissipating means. However, arcing may occur between other components of the circuit breaker as well.

Rotary contact arrangements are typically rotatably arranged on a support shaft between the fixed contact arms of the circuit breaker and function to interrupt the flow of current in the event that a short circuit occurs. A rotary contact arrangement employs a rotor and a pair of rotor springs to maintain contact between the movable contact arms and the fixed contact arms, thus maintaining a good electrical connection between the contacts. The compression forces provided by the rotor springs must be overcome when the contacts become separated and the circuit "blows open" due to the occurrence of opposing electrodynamic repulsion fields between the movable contact arm and the fixed contact arm.

Commonly, multiple contacts, each disposed within a cassette, are arranged within a circuit breaker system for protection of individual phases of current. The operating mechanism is positioned over one of the cassettes and generally connected to all of the cassettes in the system. The connection between the cassettes can become adversely affected under mechanical load of high stress short circuit conditions.

BRIEF SUMMARY OF THE INVENTION

The above discussed and other drawbacks and deficiencies are overcome or alleviated by a multipole cassette assembly having a center pole cassette assembly including a first side and a second side, a first outer pole cassette assembly having a first side and a second side, a first spacer interlocking receptacle positioned on one of the first side of the center pole cassette assembly and the second side of the first outer pole cassette assembly, and a first interlocking spacer positioned on one of the first side of the center pole cassette assembly and the second side of the first outer pole cassette assembly, wherein the first interlocking spacer is engaged with the first spacer interlocking receptacle.

In other embodiments, a circuit breaker having interlocking cassettes for maintaining spacing between poles of the cassettes includes a first cassette assembly, a second cassette assembly, and means for interlocking the first cassette assembly to the second cassette assembly.

In other embodiments, a method for maintaining spacing between poles of a multipole cassette assembly includes providing an interlocking spacer on a first cassette assembly, providing an interlocking receptacle on a second cassette assembly, and engaging the interlocking spacer with the interlocking receptacle.

The above discussed and other features and advantages of the present invention will be appreciated and understood by those skilled in the art from the following detailed description and drawings.

DETAILED DESCRIPTION OF THE INVENTION

Figure 1:
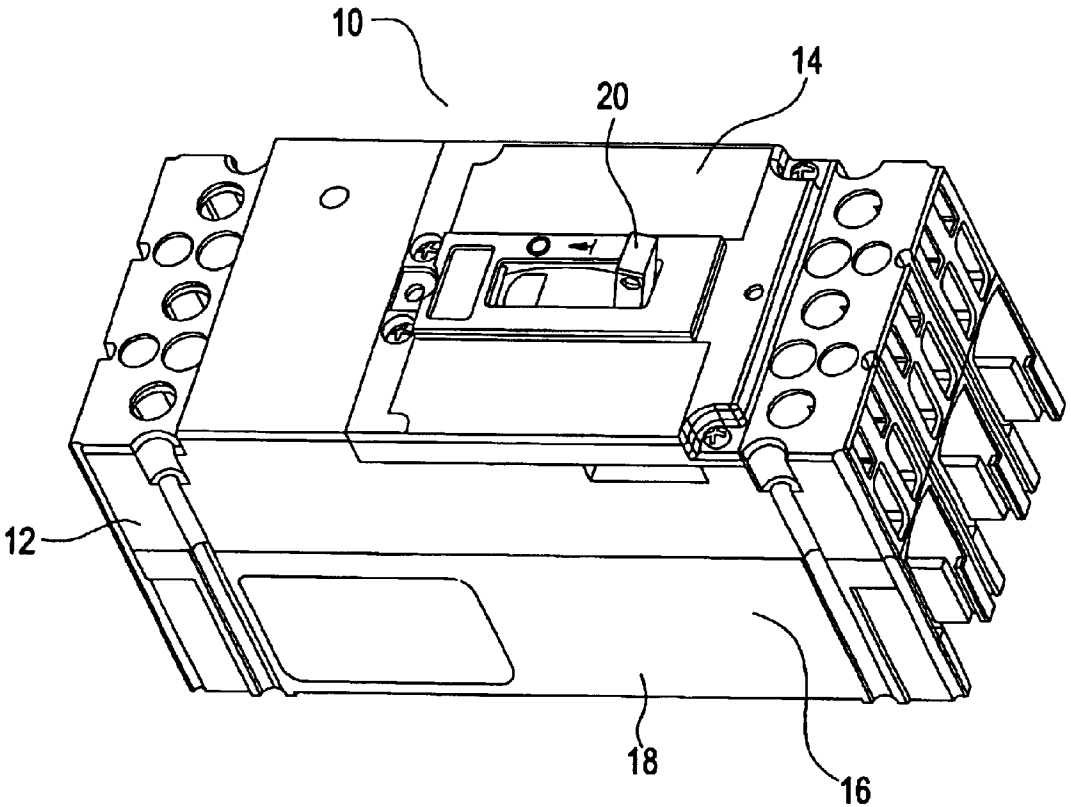
FIG. 1 shows a perspective view of a circuit breaker.
Figure 2:
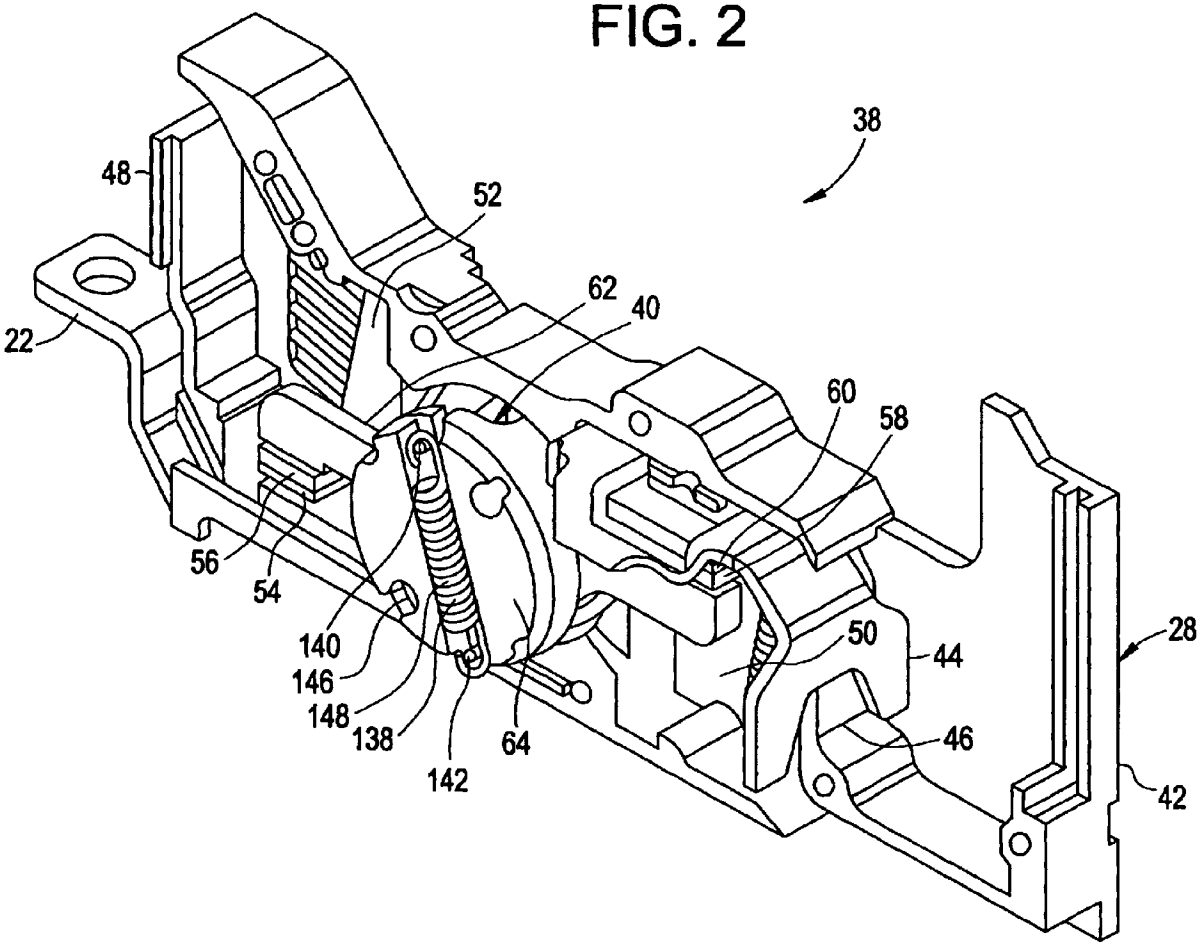
FIG. 2 shows a perspective view of a circuit breaker cassette assembly.

Referring to FIG. 1, an embodiment of a molded case circuit breaker 10 is generally shown. Circuit breakers of this type generally have an insulated case 16 having a cover 14 attached to a mid-cover 12 coupled to a base 18. A handle 20 extending through cover 14 gives the operator the ability to turn the circuit breaker 10 "on" to energize a protected circuit (as shown in FIG. 2), turn the circuit breaker "off" to disconnect the protected circuit (not shown), or "reset" the circuit breaker after a fault (not shown). A plurality of line-side contact and load-side straps also extend through the case 16 for connecting the circuit breaker 10 to the line and load conductors of the protected circuit. The circuit breaker 10 in FIG. 1 shows a typical three phase configuration, however, the present invention is not limited to this configuration but may be applied to other configurations, such as one, two, four, or more phase circuit breakers.

The handle 20 is attached to a circuit breaker operating mechanism, not shown, which is coupled with a center cassette and is connected with outer cassettes by a drive pin. The cassettes along with the circuit breaker operating mechanism are assembled into base 18 and retained therein by the mid-cover 12. The mid-cover 12 is connected to the base 18 by any convenient means, such as screws, snap-fit, or adhesive bonding. A cover 14 may be attached to the mid-cover 12 by screws.

Referring to FIG. 2, a circuit breaker cassette assembly 38 is shown and comprises a rotary contact assembly, shown generally at 40, in a first electrically insulative cassette half-piece 42 of center cassette 28 intermediate a line-side contact strap 22, and a load-side contact strap 44. Line-side contact strap 22 is electrically connectable to line-side wiring (not shown) in an electrical distribution circuit, and load-side contact strap 44 is electrically connectable to load-side wiring (not shown) via a lug (not shown) or a mechanism such as a bimetallic element or current sensor (not shown). Electrically insulative shields 46, 48 separate load-side contact strap 44 and line-side contact strap 22 from the associated arc chute assemblies 50, 52, respectively. Although only a single circuit breaker cassette assembly 38 is shown, a separate circuit breaker cassette assembly 38 is employed for each pole of a multi-pole circuit breaker and operated in a manner similar to that of circuit breaker cassette assembly 38.

Electrical transport through rotary contact assembly 40 of circuit breaker cassette assembly 38 occurs from line-side contact strap 22 to an associated first fixed contact 54, through first and second movable contacts 56, 58 secured to the ends of a movable contact arm, shown generally at 62, and to an associated second fixed contact 60 on load-side contact strap 44. Movable contact arm 62 is pivotally arranged between two halves of a rotor 64 and moves in conjunction with rotor 64 upon manual articulation of rotor 64. Rotor 64 is rotatably positioned on a rotor pivot axle, the ends of which are supported by inner parallel walls of first electrically-insulative cassette half-piece 42.

The circular rotor 64 includes a contact spring slot 148 formed on each side thereof. A first contact spring 138 extends between a pair of spring pins 140, 142 within contact spring slot 148 and a second contact spring (not shown) extends between pins 140, 142 in a similar manner on the opposite side of rotor 64. An aperture 146 extends through rotor 64. Aperture 146 allows for a link connection by means of an extended rotor pin or drive pin 34 with the circuit breaker operating mechanism to allow a manual intervention for opening and closing the circuit breaker contacts.

The arc chute assemblies 50, 52 are positioned in the first electrically insulative cassette half piece 42 adjacent the respective pairs of first fixed and first moveable contacts 54, 56, and second fixed and second moveable contacts 60, 58. The first and second movable contacts 56, 58 and moveable contact arm 62 move through a passageway provided by the arc chute assemblies 50, 52 in order to engage and disengage from the respective first and second fixed contacts 54, 60. Each arc chute assembly 50, 52 is adapted to interrupt and extinguish the arc which forms when the circuit breaker 10 is tripped and the first and second moveable contacts 56, 58 are suddenly separated from the first and second fixed contacts 54, 60.

Figure 3:
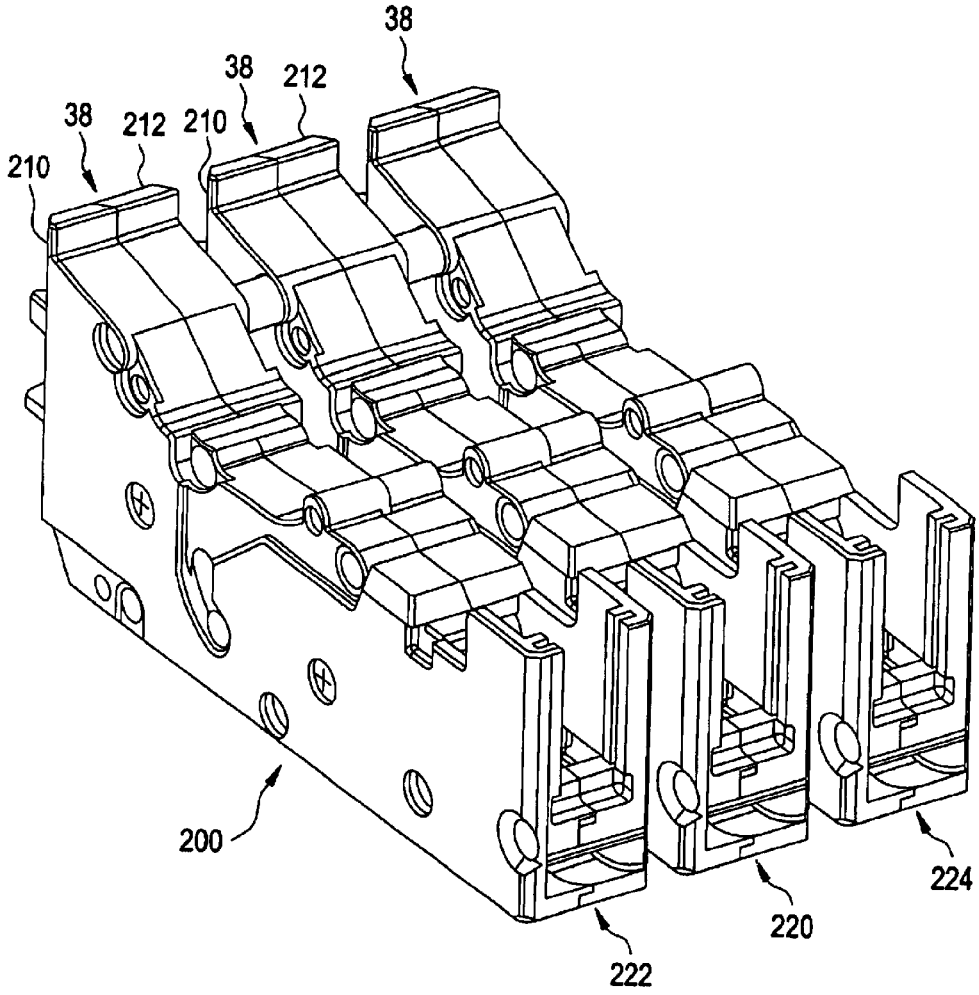
FIG. 3 shows a perspective view of three poles assembled together.

It should be understood that a multi-pole circuit breaker should include additional circuit breaker cassette assemblies that may be similarly constructed to circuit breaker cassette assembly 38 including rotary contact assembly 40 described herein. As shown in FIG. 3, there may be three cassette assemblies 38 assembled together to reduce the play and maintain critical spacing between poles of a multi-pole cassette assembly 200. Although only a single insulative cassette half-piece 42 is shown in FIG. 2, it should be understood that each fully assembled cassette assembly 38 includes both first and second insulative cassette half-pieces 210, 212. In the embodiment shown in FIG. 3, the multi-pole cassette assembly 200 may include a center pole cassette assembly 220, a first outer pole cassette assembly 222, and a second outer pole cassette assembly 224. Although only three poles are shown, it should be understood that more or less poles could be included in the multi-pole cassette assembly 200 using the interlocking and fastening methods described herein.

This system includes a method for interlocking and fastening multi-pole cassettes 38 to maintain dimensional stability and simultaneous coordination of operation under mechanical load of high stress short circuit conditions. This system is usable in any multi-pole circuit breaker, as well as alternate cassette arrangements.

Figure 4:
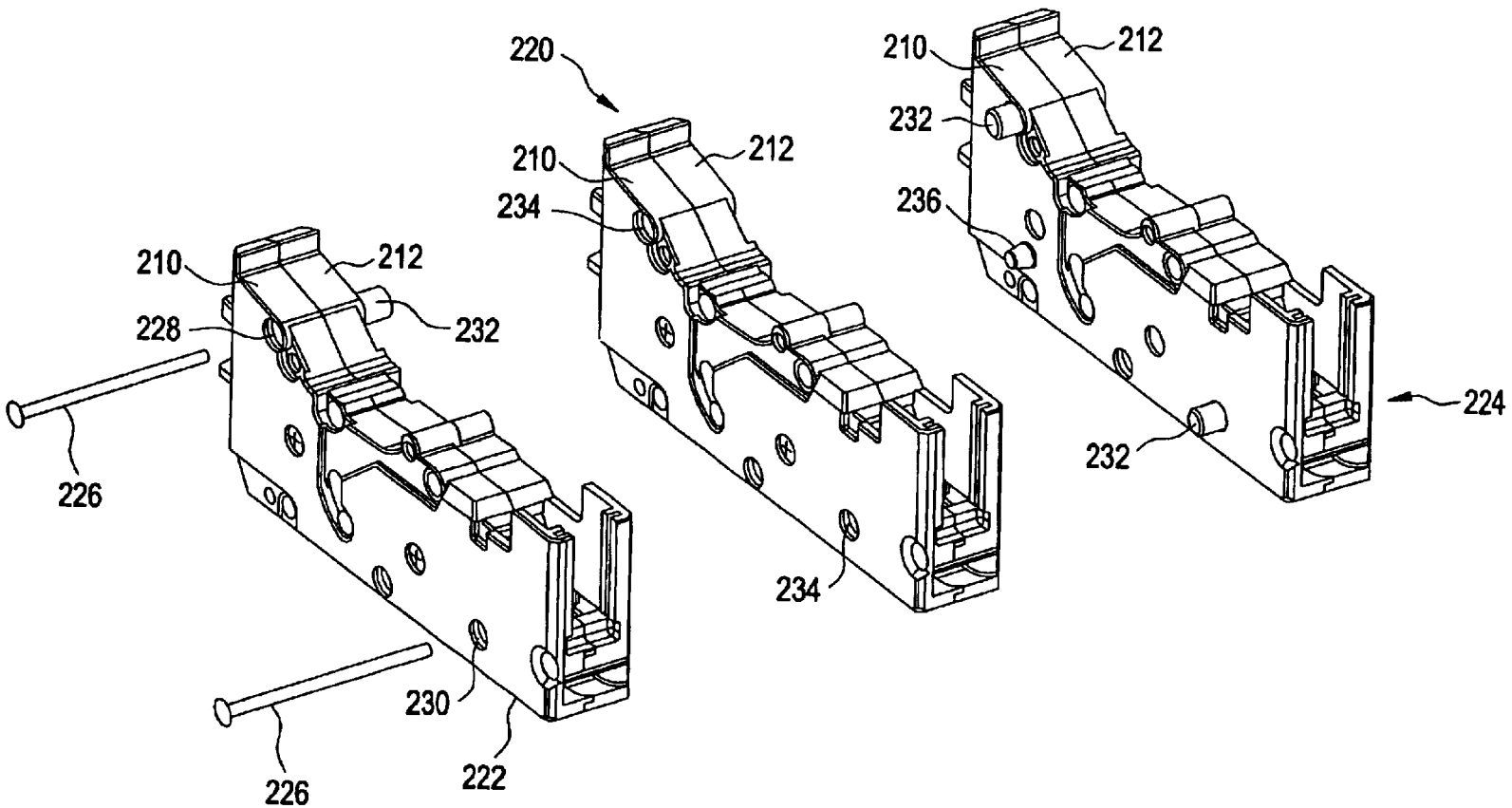
FIG. 4 shows an exploded perspective view of the three poles of FIG. 3 with interconnecting rivets.

FIG. 4 shows an exploded view of all the poles or cassette assemblies 38 along with long rivets 226. The long rivets 226 are used to connect all poles 220, 222, 224 and maintain dimensional stability during high stress conditions such as short circuit. While only two rivets 226 are shown, it should be understood that the cassette assemblies 38 could be modified to accommodate additional rivets 226.

The rivets 226 may pass through apertures 228, 230 positioned on a first cassette half piece 210 of the first outer pole cassette assembly 222. The apertures 228 and 230 preferably lead to first and second interlocking spacers 232 on the second cassette half piece 212 of the first outer pole cassette assembly 222. It should be understood that while only one interlocking spacer 232 is viewable in FIG. 4, a second interlocking spacer 232 is positioned about the same longitudinal axis as that of aperture 230, just as a first interlocking spacer 232 is positioned about the same longitudinal axis as that of aperture 228.

The center pole cassette assembly 220 includes first and second spacer interlocking receptacles 234 positioned on the first cassette half piece 210, which faces the second cassette half piece 212 of the first outer pole cassette assembly 222. Although not shown, the center pole cassette assembly 220 further includes first and second spacer interlocking receptacles 234 positioned on its second cassette half piece 212, which faces the first cassette half piece 210 of the second outer pole cassette assembly 224.

The first and second spacer interlocking receptacles 234 on the first cassette half piece 210 of the center pole cassette assembly 220 and the first and second spacer interlocking receptacles 234 on the second cassette half piece 212 of the center pole cassette assembly 220 are preferably positioned about the same longitudinal axis, respectively Furthermore, the first spacer interlocking receptacle 234 on the first cassette half piece 210 of the center pole cassette assembly 220 and the first spacer interlocking receptacle 234 on the second cassette half piece 212 of the center pole cassette assembly 220 preferably form a continuous passage for receipt of a rivet 226, as will be further described. Likewise, the second spacer interlocking receptacle 234 on the first cassette half piece 210 of the center pole cassette assembly 220 and the second spacer interlocking receptacle 234 on the second cassette half piece 212 of the center pole cassette assembly 220 preferably form a continuous passage for receipt of a rivet 226, as will also be further described.

The second outer pole cassette assembly 224 may include first and second interlocking spacers 232 on a first cassette half piece 210 of the second outer pole cassette assembly 224, which faces the second cassette half piece 212 of the center pole cassette assembly 220. All of the spacer interlocks 234 may be molded on the first and second outer pole cassettes 222, 224 to achieve proper spacing and eliminate lateral movement between the poles. While molding is described, the spacer interlocks 234 may also be attached by mechanical methods such as screwing, gluing, or otherwise securing the spacer interlocks 234 to the cassette assemblies.

When assembled, the first and second interlocking spacers 232 on the second cassette half piece 212 of the first outer pole cassette assembly 222 are sized and located for interlocking engagement with first and second spacer interlocking receptacles 234 on the first cassette half piece 210 of the center pole cassette assembly 220. Likewise, the first and second interlocking spacers 232 on the first cassette half piece 210 of the second outer pole cassette assembly 224 are sized and located for interlocking engagement with first and second spacer interlocking receptacles 234 on the second cassette half piece 212 of the center pole cassette assembly 220. This interlocking engagement may come in the form of a snap fit connection, friction fit, partial insertion of the spacers 232 into the receptacles 234, or other suitable mechanical interlocking engagement. This particular arrangement also helps in the ease of assembly. The whole cassette assembly goes into the base as a single unit because of this arrangement.

While the receptacles 234 are described in conjunction with the center pole cassette assembly 220 and the spacers 232 are described in conjunction with the first and second outer pole cassette assemblies 222, 224, it should be understood that it would also be within the scope of this invention to provide the spacers 232 on the center pole cassette assembly 220 and the receptacles 234 on the first and second outer pole cassette assemblies 222, 224. Also, while two pairs of receptacles 234 and spacers 232 are described, it should be understood that additional spacers 232 and receptacles 234 may also be provided.

With the spacers 232 in engagement with the receptacles 234 as described above, the rivets 226 may pass continuously through unblocked longitudinal apertures created by the combination of the apertures 228, 230 on the first cassette half piece 210 of the first outer pole cassette assembly 222, the spacers 232 on the second cassette half piece 212 of the first outer pole cassette assembly 222, the receptacles 234 on the center pole cassette assembly 220, and the spacers 232 on the first cassette half piece 210 of the second outer pole cassette assembly 224. If more rivets are to be used, then additional pairs of spacers 232 and receptacles 234 should correspondingly be provided. It should be understood that there are apertures on the second cassette half piece 212 of the second outer pole cassette assembly 224, just like apertures 228, 230 on the first outer pole cassette assembly 224. The rivets 226 preferably pass all the way through the second outer pole cassette assembly 224.

In addition to the spacer interlocking receptacles 234 and the interlocking spacers 232 which help achieve proper spacing and eliminate lateral movement between the poles, standoffs 236 may be further provided to assist in spacing between the poles. As shown in FIG. 4, a standoff 236 may be provided on the first cassette half piece 210 of the second outer pole cassette assembly 224. Although not shown, another standoff 236 may be provided on the second cassette half piece 212 of the first outer pole cassette assembly 222. The standoffs 236 are positioned to abut against the first and second cassette half pieces 210, 212 of the center pole cassette assembly 220. The length of the standoffs 236 preferably defines a desired spacing between outer poles and the center pole. While the standoffs 236 are shown with respect to the first and second outer pole cassette assemblies 222, 224, it should be understood that standoffs 236 could also or instead be provided on the center pole cassette assembly 220.

While the number of rivets 226 may be increased, it should be understood that placement of the rivets 226 requires careful consideration of the internal elements within the cassette assemblies 38 so as not to disturb the internal functions of the circuit breaker 10. For employing two rivets 226 as shown, a first rivet 226 is positioned adjacent an upper corner of the cassette assemblies on one side of the cassette assemblies 38 and a second rivet 226 is positioned adjacent a lower corner of the cassette assemblies 38 on an opposite side of the cassette assemblies 38.

A method for providing stability to multi pole cassette assemblies and maintaining spacing between poles of multi pole cassette assemblies includes providing an interlocking spacer on a first cassette assembly, providing an interlocking receptacle on a second cassette assembly, and engaging the interlocking spacer with the interlocking receptacle. In such an exemplary method, the first cassette assembly may be one of the center pole cassette assembly, the first outer pole cassette assembly, or the second outer pole cassette assembly, and the second cassette assembly may be any abutting cassette assembly. The method may further comprise passing a rivet through the interlocking spacer and the interlocking receptacle and may further comprise providing a standoff on one of the first cassette assembly and the second cassette assembly and abutting a side of another of the first cassette assembly and the second cassette assembly with the standoff. Of course, it should be understood that the method may further include providing the other elements of a multipole cassette assembly as described with reference to FIGS. 3 and 4.

With this system, it is possible to reduce the play and maintain spacing between poles of a multi-pole cassette assembly. This system also preferably maintains adequate contact depression and minimal material erosion of contacts from pole to pole, where accurate alignment and stiffness of contact structures on multipole cassettes helps sustain maximum life. This system also preferably provides a means of maintaining accurate pole spacing and dimensional stability between cassette poles for assembly and provides a means to prevent adjacent poles from either separating or collapsing during high fault conditions. This method and assembly is also a cost effective manner of providing these advantages.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A multipole cassette assembly comprising:

a center pole cassette assembly having a first side and a second side;

a first outer pole cassette assembly having a first side and a second side;

a fist spacer interlocking receptacle positioned on one of the first side of the center pole cassette assembly and the second side of the first outer pole cassette assembly;

a first interlocking spacer positioned on one of the first side of the center pole cassette assembly and the second side of the first outer pole cassette assembly;

wherein the first interlocking spacer is engaged with the first spacer interlocking receptacle and wherein the first spacer interlocking receptacle and the first interlocking spacer form a longitudinal aperture; and, a rivet passing through the longitudinal aperture.

2. The multipole cassette assembly of claim 1 further comprising a second outer pole cassette assembly having a first side and a second side;

a second spacer interlocking receptacle positioned on one of the second side of the center pole cassette assembly and the first side of the second outer pole cassette assembly; and, a second interlocking spacer positioned on one of the second side of the center pole cassette assembly and the first side of the second outer pole cassette assembly;

wherein the second interlocking spacer is engaged with the second spacer interlocking receptacle.

3. The multipole cassette assembly of claim 1 further comprising a first standoff positioned on one of the first side of the center pole cassette assembly and the second side of the first outer pole cassette assembly, wherein the first standoff abuts another of the first side of the center pole cassette assembly and the second side of the first outer pole cassette assembly.

4. A multipole cassette assembly comprising:

a center pole cassette assembly having a first side and a second side;

a first outer pole cassette assembly having a first side and a second side;

a first spacer interlocking receptacle positioned on one of the first side of the center pole cassette assembly and the second side of the first outer pole cassette assembly;

a first interlocking spacer positioned on one of the first side of the center pole cassette assembly and the second side of the first outer pole cassette assembly;

wherein the first interlocking spacer is engaged with the first spacer interlocking receptacle; and, a first standoff positioned on one of the first side of the center pole cassette assembly and the second side of the first outer pole cassette assembly, wherein the first standoff abuts another of the first side of the center pole cassette assembly and the second side of the first outer pole cassette assembly;

wherein the first standoff has a length, the length of the first standoff defining a spacing between the center pole cassette assembly and the first outer pole cassette assembly when the multipole cassette assembly is assembled.

5. The multipole cassette assembly of claim 4 further comprising a second outer pole cassette assembly having a first side and a second side;

a second standoff positioned on one of the second side of the center pole cassette assembly and the first side of the second outer pole cassette assembly, wherein the second standoff abuts another of the second side of the center pole cassette assembly and the first side of the second outer pole cassette assembly.

6. The multipole cassette assembly of claim 4, wherein the first standoff is molded onto one of the center pole cassette assembly and the first outer pole cassette assembly.

7. The multipole cassette assembly of claim 1 wherein the first interlocking spacer is partially inserted into the first spacer interlocking receptacle.

8. A multipole cassette assembly comprising:

a center pole cassette assembly having a first side and a second side;

a first outer pole cassette assembly having a first side and a second side;

a second outer pole cassette assembly having a first side and a second side;

a first pair of interlocking spacers on the second side of the first outer pole cassette assembly;

a second pair of interlocking spacers on the first side of the second outer pole cassette assembly;

a first pair of spacer interlocking receptacles on the first side of the center pole cassette assembly engaging with the first pair of interlocking spacers; and, a second pair of spacer interlocking receptacles on the second side of the center pole cassette assembly engaging with the second pair of interlocking spacers.

9. The multipole cassette assembly of claim 8, further comprising a pair of rivets, each rivet passing through longitudinally aligned interlocking spacers and interlocking receptacles in the first outer pole cassette assembly, the center pole cassette assembly, and the second outer pole cassette assembly.

10. The multipole cassette assembly of claim 8 further comprising a first standoff on the second side of the first outer pole cassette assembly and a second standoff on the first side of the second outer pole cassette assembly, wherein the first and second standoffs define a spacing between the first outer pole cassette assembly and the center pole cassette assembly and between the center pole cassette assembly and the second outer pole cassette assembly, respectively.

11. The multipole cassette assembly of 8 wherein one spacer interlocking receptacle on the first side of the center pole cassette assembly is located adjacent an upper corner on one end of the multipole cassette assembly and wherein one spacer interlocking receptacle on the first side of the center pole cassette assembly is located adjacent a lower corner on another end of the multipole cassette assembly.

12. A circuit breaker having interlocking cassettes for maintaining spacing between poles of the cassettes, the circuit breaker comprising:

a first cassette assembly;

a second cassette assembly;

means for interlocking the first cassette assembly to the second cassette assembly, wherein the means for interlocking includes an interlocking spacer and an interlocking receptacle, wherein the interlocking spacer is at least partially engaged within the interlocking receptacle; and, a rivet passing through the interlocking spacer and interlocking receptacle.

13. The circuit breaker of claim 12 further comprising a standoff extending from one of the first cassette assembly and the second cassette assembly.

14. A method for maintaining spacing between poles of a multipole cassette assembly, the method comprising:

providing an interlocking spacer on a first cassette assembly;

providing an interlocking receptacle on a second cassette assembly;

engaging the interlocking spacer with the interlocking receptacle;

passing a rivet through the interlocking spacer and the interlocking receptacle.

15. The method of claim 14 further comprising providing a standoff on one of the first cassette assembly and the second cassette assembly and abut a side of another of the first cassette assembly and the second cassette assembly with the standoff.

16. A multipole cassette assembly comprising:

a center pole cassette assembly having a first side and a second side;

a first outer pole cassette assembly having a first side and a second side;

a first pair of spacer interlocking receptacles positioned on one of the first side of the center pole cassette assembly and the second side of the first outer pole cassette assembly; and, a first pair of interlocking spacer positioned on one of the first side of the center pole cassette assembly and the second side of the first outer pole cassette assembly;

wherein the first pair of interlocking spacers is engaged with the first pair of spacer interlocking receptacles.

17. The multipole cassette assembly of claim 16 wherein one spacer interlocking receptacle in the first pair of spacer interlocking receptacles is located adjacent an upper corner on one end of the multipole cassette assembly and one spacer interlocking receptacle in the first pair of spacer interlocking receptacles is located adjacent a lower corner on another end of the multipole cassette assembly.

18. A circuit breaker having interlocking cassettes for maintaining spacing between poles of the cassettes, the circuit breaker comprising:

a fist cassette assembly;

a second cassette assembly; and, means for interlocking the first cassette assembly to the second cassette assembly, wherein the means for interlocking includes an interlocking spacer and an interlocking receptacle, wherein the interlocking spacer is at least partially engaged within the interlocking receptacle, and wherein the interlocking spacer is molded onto a side of one of the first cassette assembly and the second cassette assembly.

* * * * *